US011033084B2

(12) United States Patent
Maddocks

(10) Patent No.: US 11,033,084 B2
(45) Date of Patent: Jun. 15, 2021

(54) STACKABLE JEWELRY SYSTEM

(71) Applicant: Staggerings, LLC, Fort Collins, CO (US)

(72) Inventor: Julie M. Maddocks, Fort Collins, CO (US)

(73) Assignee: Staggerings, LLC, Fort Collins, CO (US)

( * ) Notice: Subject to any disclaimer, the term of this patent is extended or adjusted under 35 U.S.C. 154(b) by 0 days.

(21) Appl. No.: 16/410,291

(22) Filed: May 13, 2019

(65) Prior Publication Data

US 2020/0359755 A1 Nov. 19, 2020

(51) Int. Cl.
*A44C 9/00* (2006.01)

(52) U.S. Cl.
CPC ..... *A44C 9/0023* (2013.01); *A44C 9/0007* (2013.01); *A44C 9/0015* (2013.01)

(58) Field of Classification Search
CPC ..... A44C 9/00; A44C 9/0007; A44C 9/0015; A44C 9/0023; Y10T 403/7045; Y10T 403/7007
USPC ..... D11/26, 28
See application file for complete search history.

(56) References Cited

U.S. PATENT DOCUMENTS

| | | | | |
|---|---|---|---|---|
| 1,758,447 | A | 5/1930 | Liebs | |
| 2,016,679 | A | 10/1935 | Mayer | |
| 5,377,505 | A * | 1/1995 | McVay, III | A45D 29/17 63/15 |
| 5,419,158 | A | 5/1995 | Sandberg et al. | |
| D439,189 | S * | 3/2001 | Gueit | D11/26 |
| 6,484,536 | B1 | 11/2002 | Gould | |
| D639,199 | S * | 6/2011 | Liberman | D11/26 |
| 8,448,464 | B2 | 5/2013 | Varcin | |
| 2002/0169050 | A1* | 11/2002 | Gehring | F16H 57/08 475/331 |
| 2012/0090356 | A1* | 4/2012 | Liberman | A63B 23/16 63/3 |
| 2012/0159988 | A1* | 6/2012 | Baird | A44C 5/102 63/11 |
| 2014/0116086 | A1* | 5/2014 | Casaccio | A44C 5/0053 63/5.1 |
| 2015/0192156 | A1* | 7/2015 | Lee | A44B 13/007 403/364 |
| 2016/0113362 | A1* | 4/2016 | Roux-Fouillet | A44C 13/00 63/3 |
| 2018/0352829 | A1* | 12/2018 | Diamond | A44C 9/00 |

FOREIGN PATENT DOCUMENTS

| | | | | |
|---|---|---|---|---|
| DE | 29620070 U1 * | 2/1997 | | A44C 9/00 |
| DE | 202011108847 U1 * | 1/2012 | | A44C 9/0015 |
| FR | 2563708 A1 * | 11/1985 | | A44C 27/00 |

OTHER PUBLICATIONS

Ducret English translation (Year: 1985).*
Rinfit. Silicone wedding Rings. Website, https://www.rinfit.come, originally downloaded May 8, 2019, 3 pages.

* cited by examiner

*Primary Examiner* — Emily M Morgan
(74) *Attorney, Agent, or Firm* — Craig R. Miles; CR Miles P.C.

(57) ABSTRACT

A stackable jewelry system including first and second bands which can be stackable to form a stacked configuration in which (i) the first and second bands dispose in coaxial relation, and (ii) a second protrusion of the second band can be capable of radial alignment with a first opening of the first band.

12 Claims, 14 Drawing Sheets

1/30

STACKABLE JEWELRY SYSTEM

I. SUMMARY OF THE INVENTION

A broad object of a particular embodiment of the invention can be to provide a stackable jewelry system, and methods of making and using such a stackable jewelry system, whereby the stackable jewelry system can include a first band comprising a first annular member having first annular member outer and inner faces coupled together by first annular member upper and lower faces; at least two first protrusions axially extending from one of the first annular member upper or lower faces in circumferentially spaced-apart relation, the first protrusion having first protrusion outer and inner faces; and a first opening between the first protrusions, the first opening communicating with a first band interior space. At least one of (i) the first protrusion outer face can be radially offset from the first annular member outer face, or (ii) the first protrusion inner face can be radially offset from the first annular member inner face.

Another broad object of a particular embodiment of the invention can be to additionally provide a second band comprising a second annular member having second annular member outer and inner faces coupled together by second annular member upper and lower faces; and at least one second protrusion axially extending from one of the second annular member upper or lower faces, the second protrusion having second protrusion outer and inner faces. At least one of (i) the second protrusion outer face can be radially offset from the second annular member outer face, or (ii) the second protrusion inner face can be radially offset from the second annular member inner face.

The first and second bands can be stackable to form a stacked configuration in which (i) the first and second bands dispose in coaxial relation, and (ii) the second protrusion can be capable of radial alignment with the first opening.

Naturally, further objects of the invention are disclosed throughout other areas of the specification, drawings, and claims.

II. BRIEF DESCRIPTION OF THE DRAWINGS

III. DETAILED DESCRIPTION OF THE PREFERRED EMBODIMENTS

Figure 1B:
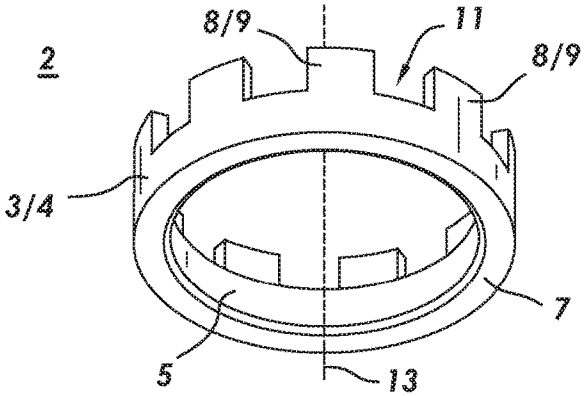
FIG. 1B shows a bottom perspective view of the band illustrated in FIG. 1A.
Figure 1D:
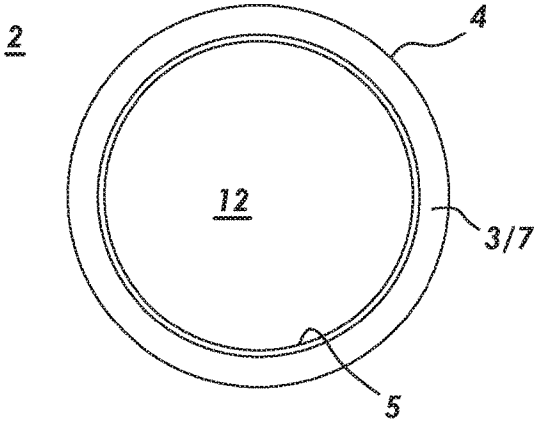
FIG. 1D shows a bottom view of the band illustrated in FIG. 1A.
Figure 1K:
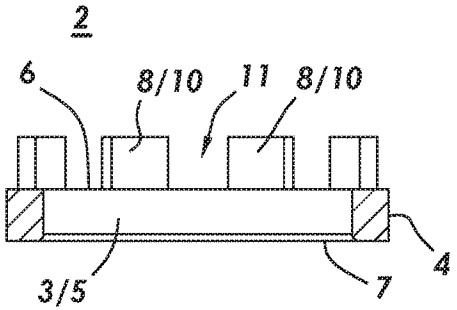
FIG. 1K is a cross-sectional view of the band illustrated in FIG. 1C.
Figure 1A:
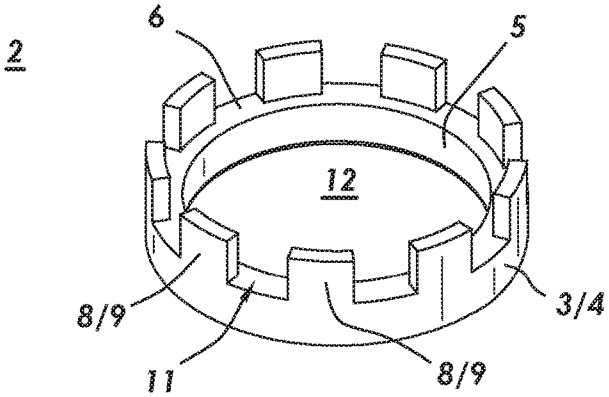
FIG. 1A shows a top perspective view of a particular embodiment of a band of the stackable jewelry system.
Figure 1C:
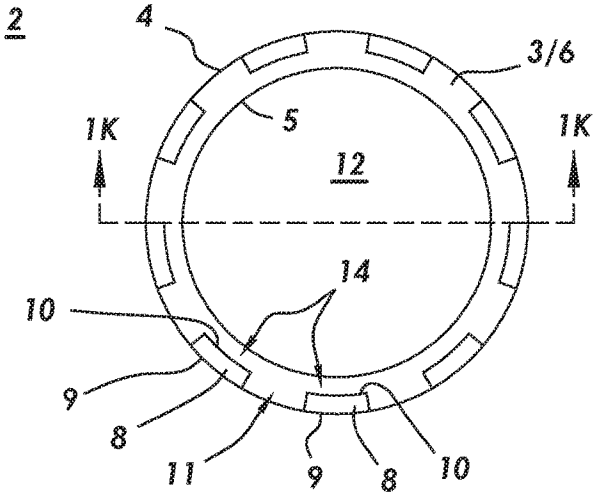
FIG. 1C shows a top view of the band illustrated in FIG. 1A.
Figure 1E:
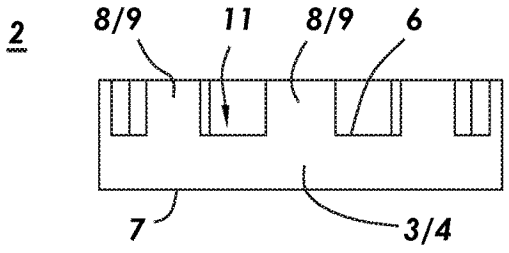
FIG. 1E shows a front view of the band illustrated in FIG. 1A.
Figure 1F:
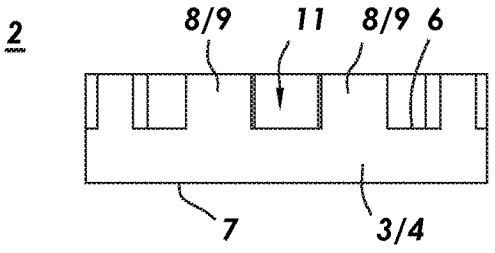
FIG. 1F shows a rear view of the band illustrated in FIG. 1A.
Figure 1G:
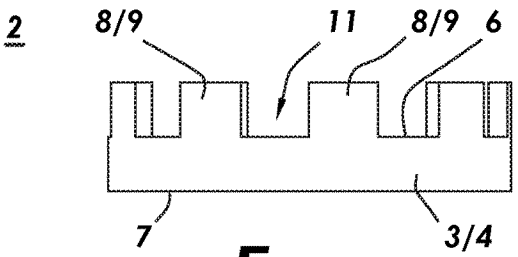
FIG. 1G shows a left side view of the band illustrated in FIG. 1A.
Figure 1H:
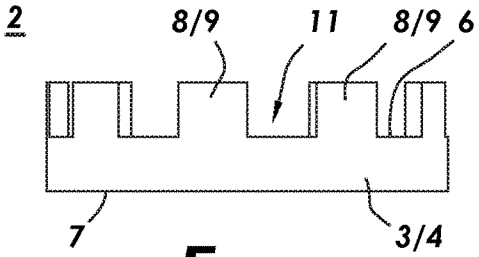
FIG. 1H shows a right side view of the band illustrated in FIG. 1A.
Figure 1I:
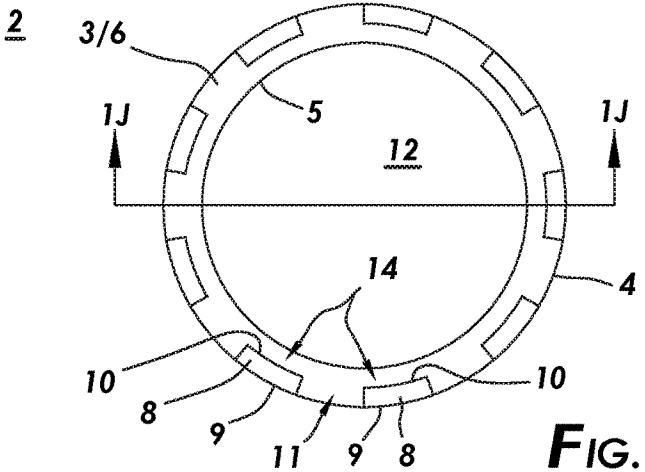
FIG. 1I shows a top view of the band illustrated in FIG. 1A, whereby this band is rotated counterclockwise by 90°.
Figure 1J:
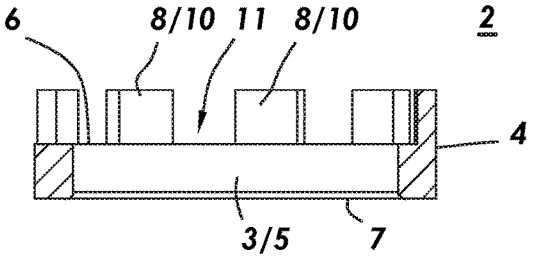
FIG. 1J is a cross-sectional view of the band illustrated in FIG. 1I.
Figure 2B:
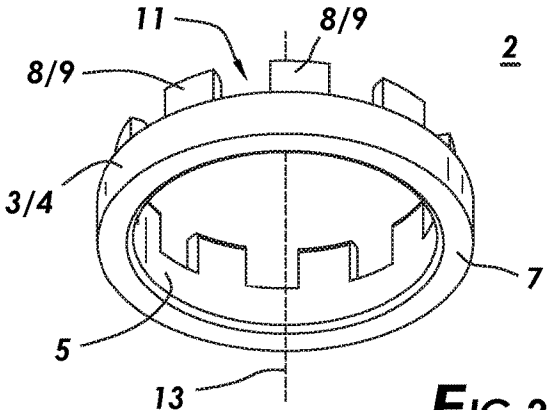
FIG. 2B shows a bottom perspective view of the band illustrated in FIG. 2A.
Figure 2D:
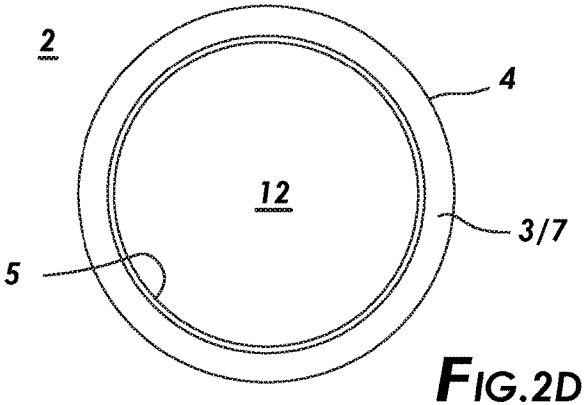
FIG. 2D shows a bottom view of the band illustrated in FIG. 2A.
Figure 2K:
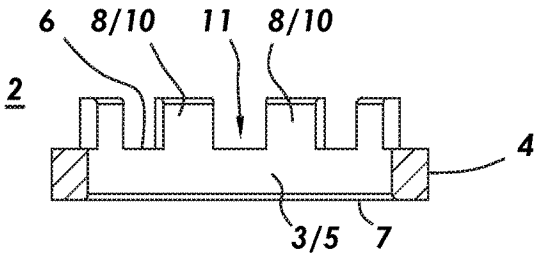
FIG. 2K is a cross-sectional view of the band illustrated in FIG. 2C.
Figure 2A:
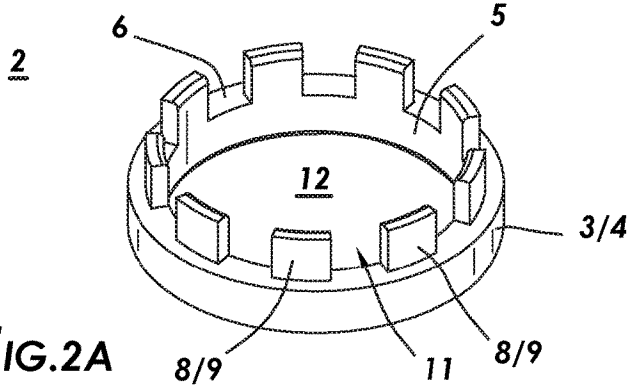
FIG. 2A shows a top perspective view of a particular embodiment of a band of the stackable jewelry system.
Figure 2C:
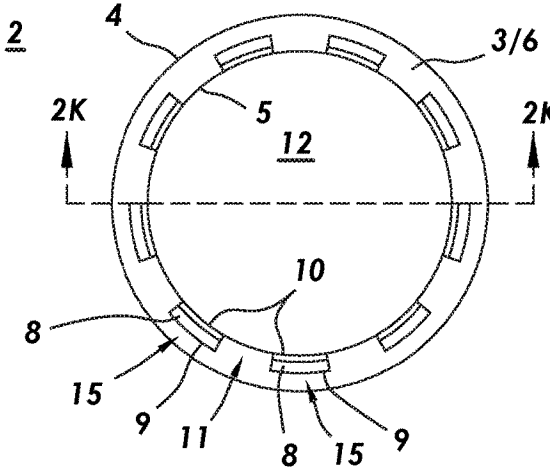
FIG. 2C shows a top view of the band illustrated in FIG. 2A.
Figure 2E:
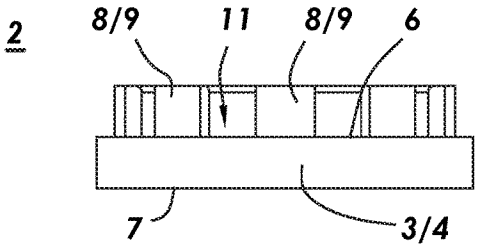
FIG. 2E shows a front view of the band illustrated in FIG. 2A.
Figure 2F:
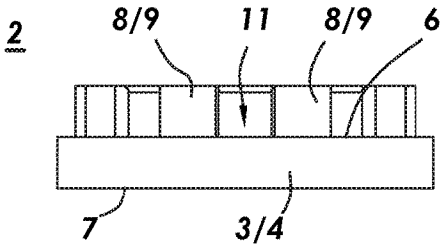
FIG. 2F shows a rear view of the band illustrated in FIG. 2A.
Figure 2G:
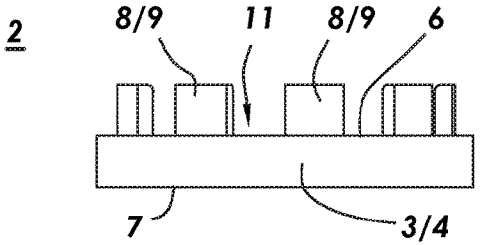
FIG. 2G shows a left side view of the band illustrated in FIG. 2A.
Figure 2H:
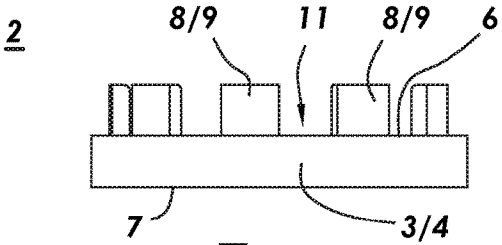
FIG. 2H shows a right side view of the band illustrated in FIG. 2A.
Figure 2I:
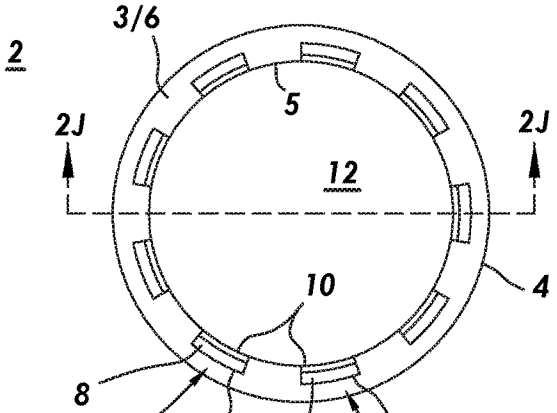
FIG. 2I shows a top view of the band illustrated in FIG. 2A, whereby this band is rotated counterclockwise by 90°.
Figure 2J:
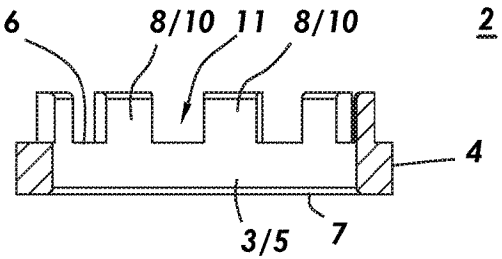
FIG. 2J is a cross-sectional view of the band illustrated in FIG. 2I.
Figure 3B:
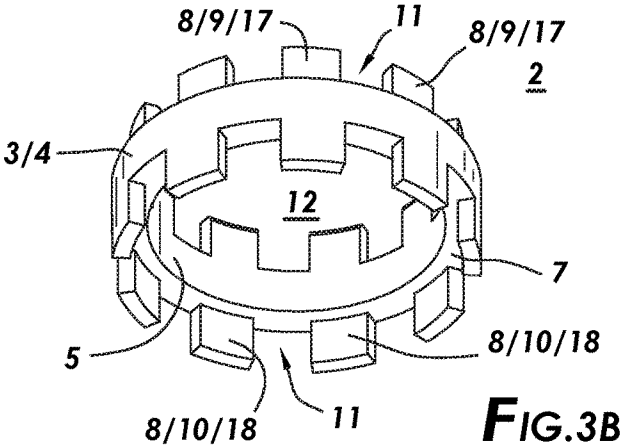
FIG. 3B shows a bottom perspective view of the band illustrated in FIG. 3A.
Figure 3D:
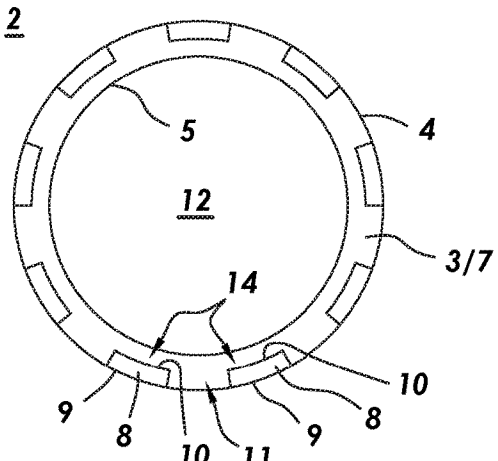
FIG. 3D shows a bottom view of the band illustrated in FIG. 3A.
Figure 3A:
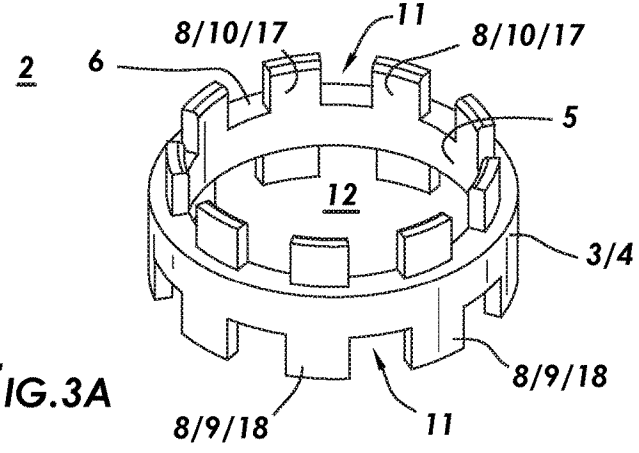
FIG. 3A shows a top perspective view of a particular embodiment of a band of the stackable jewelry system.
Figure 3C:
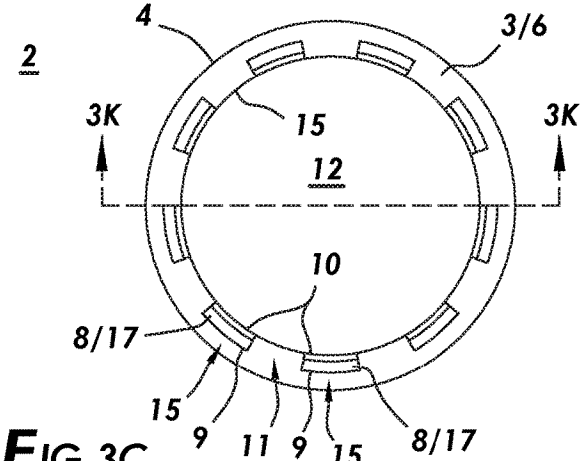
FIG. 3C shows a top view of the band illustrated in FIG. 3A.
Figure 3K:
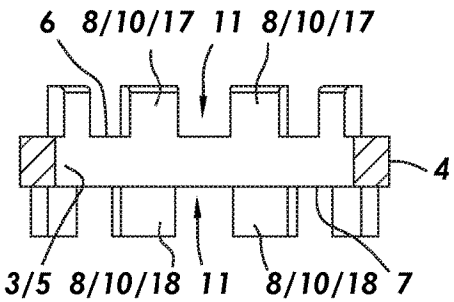
FIG. 3K is a cross-sectional view of the band illustrated in FIG. 3C.
Figure 3F:
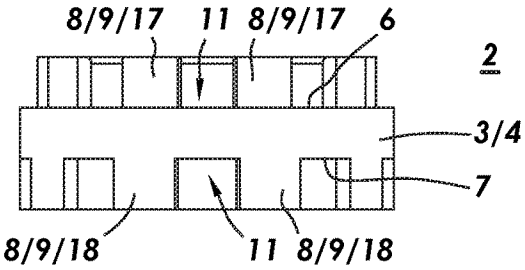
FIG. 3F shows a rear view of the band illustrated in FIG. 3A.
Figure 3H:
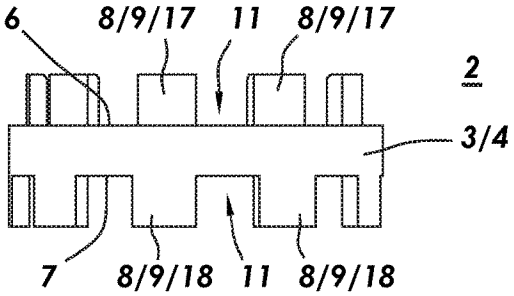
FIG. 3H shows a right side view of the band illustrated in FIG. 3A.
Figure 3J:
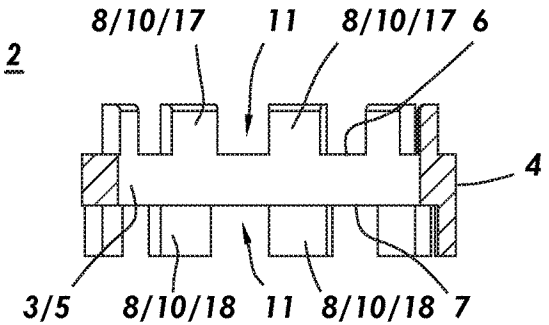
FIG. 3J is a cross-sectional view of the band illustrated in FIG. 3I.
Figure 3E:
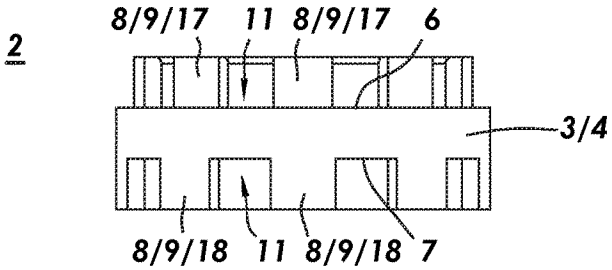
FIG. 3E shows a front view of the band illustrated in FIG. 3A.
Figure 3G:
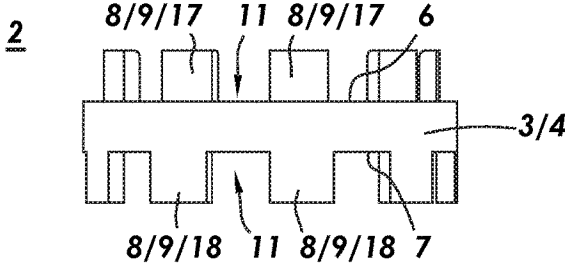
FIG. 3G shows a left side view of the band illustrated in FIG. 3A.
Figure 3I:
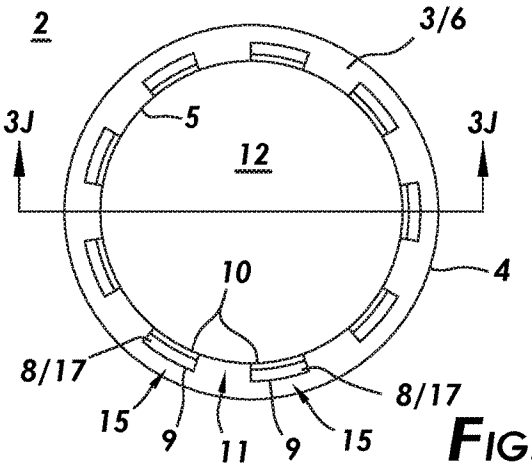
FIG. 3I shows a top view of the band illustrated in FIG. 3A, whereby this band is rotated counterclockwise by 90°.
Figure 4B:
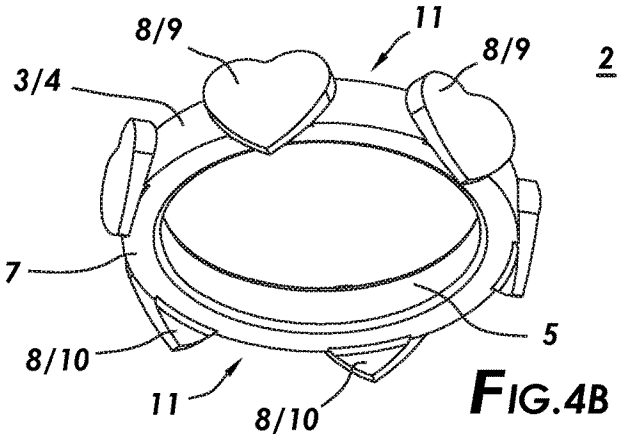
FIG. 4B shows a bottom perspective view of the band illustrated in FIG. 4A.
Figure 4D:
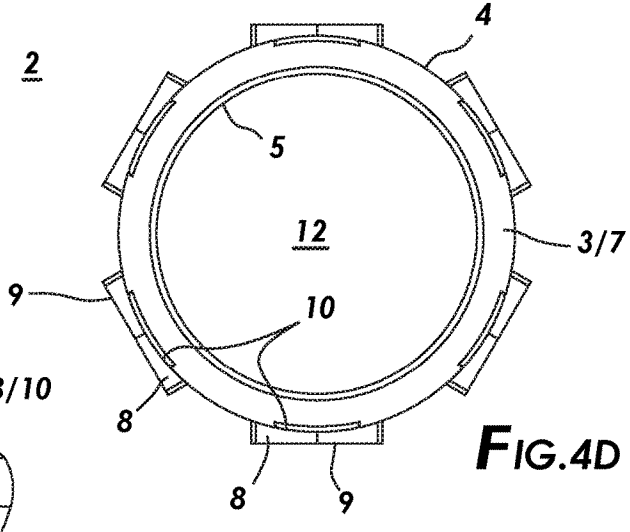
FIG. 4D shows a bottom view of the band illustrated in FIG. 4A.
Figure 4K:
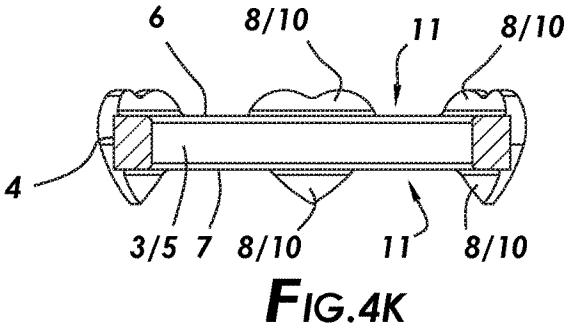
FIG. 4K is a cross-sectional view of the band illustrated in FIG. 4C.
Figure 4A:
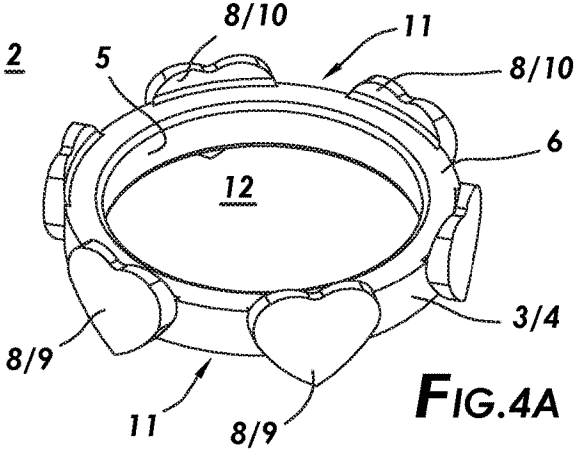
FIG. 4A shows a top perspective view of a particular embodiment of a band of the stackable jewelry system.
Figure 4C:
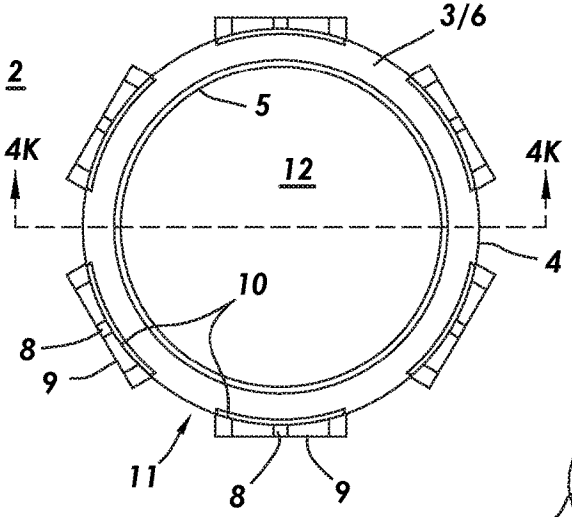
FIG. 4C shows a top view of the band illustrated in FIG. 4A.
Figure 4F:
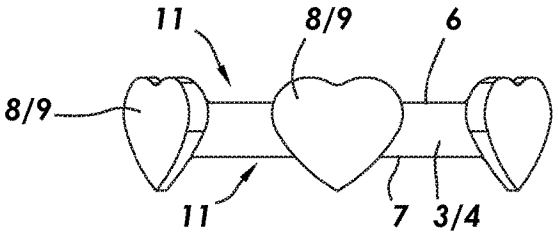
FIG. 4F shows a rear view of the band illustrated in FIG. 4A.
Figure 4H:
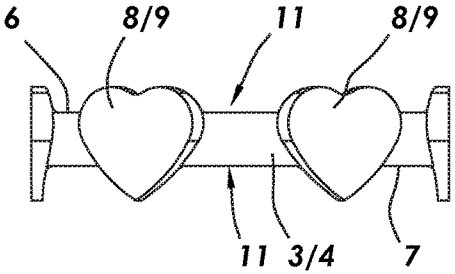
FIG. 4H shows a right side view of the band illustrated in FIG. 4A.
Figure 4J:
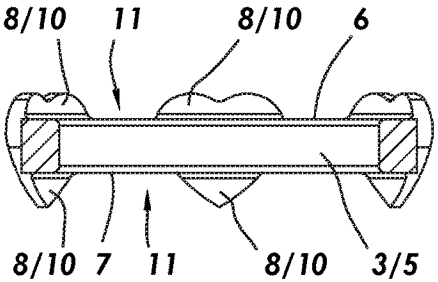
FIG. 4J is a cross-sectional view of the band illustrated in FIG. 4I.
Figure 4E:
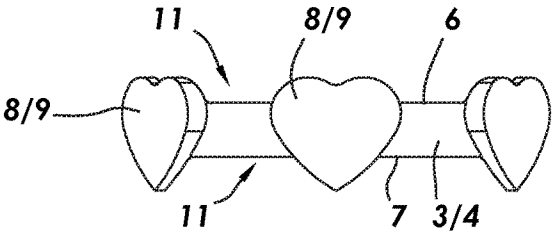
FIG. 4E shows a front view of the band illustrated in FIG. 4A.
Figure 4G:
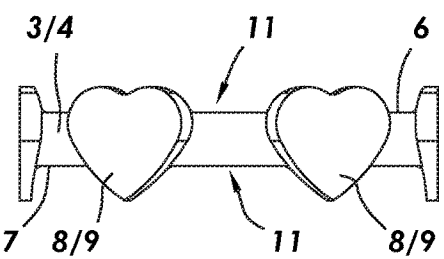
FIG. 4G shows a left side view of the band illustrated in FIG. 4A.
Figure 4I:
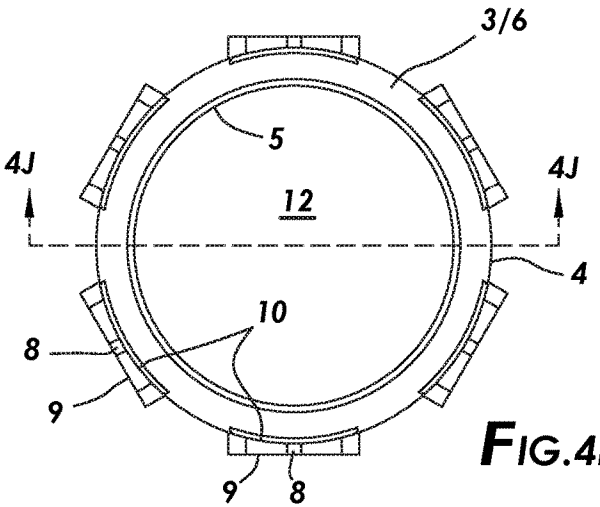
FIG. 4I shows a top view of the band illustrated in FIG. 4A, whereby this band is rotated counterclockwise by 90°.
Figure 5C:
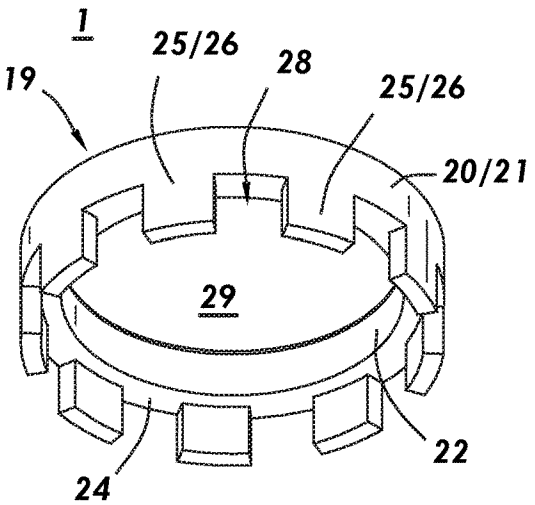
FIG. 5C shows a bottom perspective exploded view of the stacked configuration illustrated in FIG. 5A.
Figure 5C:
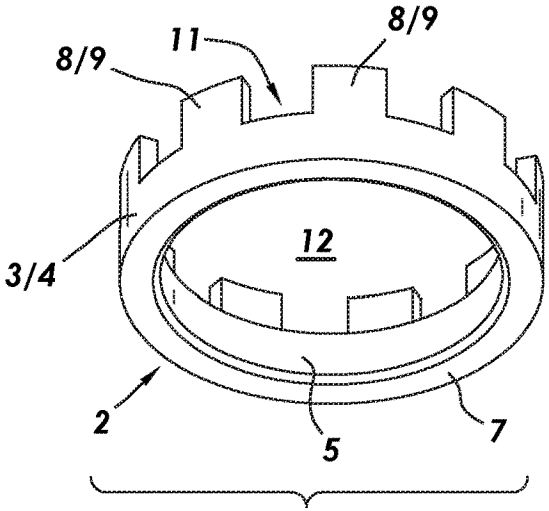
Figure 5B:
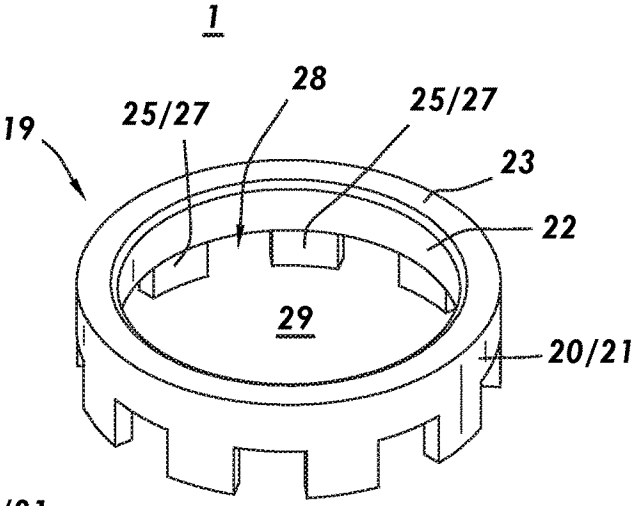
FIG. 5B shows a top perspective exploded view of the stacked configuration illustrated in FIG. 5A.
Figure 5B:
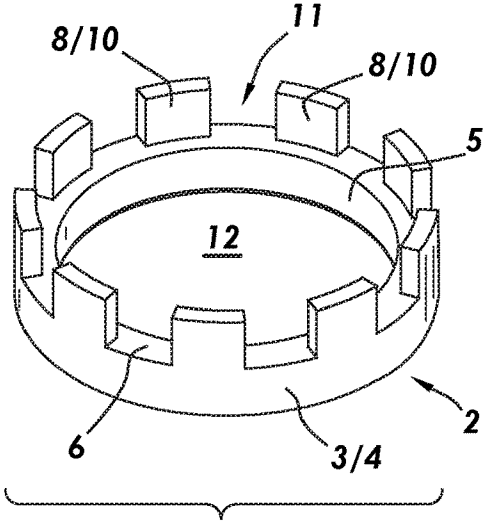
Figure 5A:
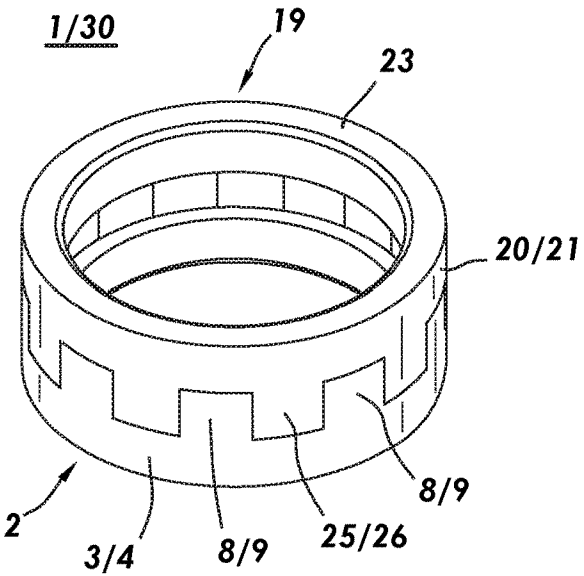
FIG. 5A shows a top perspective view of a stacked configuration of particular embodiments of first and second bands of the stackable jewelry system.

A stackable jewelry system (1) generally includes a first band (2) comprising (i) a first annular member (3) having opposing first annular member outer and inner faces (4)(5) coupled or connected together by opposing first annular member upper and lower faces (6)(7), (ii) at least two first protrusions (8) axially extending from one of the first annular member upper or lower faces (6)(7) in circumferentially spaced-apart relation, the first protrusion (8) having opposing first protrusion outer and inner faces (9)(10), and (iii) a first opening (11) between the first protrusions (8), the first opening (11) communicating with a first band interior space (12). At least one of (i) the first protrusion outer face (9) can be radially offset from the first annular member outer face (4), or (ii) the first protrusion inner face (10) can be radially offset from the first annular member inner face (5).

In this disclosure, the term "band" means an encircling strip, whereby the strip may or may not have a circular cross section, depending upon the embodiment.

Additionally of note, in this disclosure, various directional references (e.g., proximal, distal, upper, lower, upward, downward, side, lateral, left, right, front, rear, back, top, bottom, above, below, vertical, horizontal, clockwise, counterclockwise, or the like) are only used to provide a frame of reference in conjunction with the figures for aiding in the reader's understanding of the present invention, and these directional references should not be construed as creating limitations, particularly as to the position, orientation, or use of the invention.

First Annular Member

Now referring primarily to FIGS. 1A through 4K, as to particular embodiments, the first annular member (3) can be generally cylindrical, thus having a generally circular cross section, whereby the first annular member (3) can have a shape and size, or first annular member outer and inner faces (4)(5) and first annular member upper and lower faces (6)(7), which may be similar to a ring or circular band, typically worn on a figure (or toe).

As to other particular embodiments, the annular member (3) can have a shape and size which may be similar to a bracelet or circular band, typically worn on a wrist (or ankle).

The first annular member outer face (4) can provide the outer circumference of the first annular member (3) and correspondingly, the outer diameter can be the length of a straight line from one point on the first annular member outer face (4), through the center, to an opposite point on the first annular member outer face (4).

Likewise, the first annular member inner face (5) can provide the inner circumference of the first annular member (3) and correspondingly, the inner diameter can be the length of a straight line from one point on the first annular member inner face (5), through the center, to an opposite point on the first annular member inner face (5).

Now referring primarily to FIGS. 1C, 1D, 2C, 2D, 3C, 3D, 4C, and 4D, as to particular embodiments, each of the first annular member outer or inner faces (4)(5) can independently be a generally cylindrical surface, whereby a generally vertical line (parallel to the y-axis of an xyz coordinate axis system) connects the face's topmost and bottommost points which are coplanar within a z-plane of the xyz coordinate axis system. As to other particular embodiments, each of the first annular member outer or inner faces (4)(5) can independently be a generally conical surface, whereby one or more angled lines connect the face's topmost and bottommost points which are coplanar within a z-plane of the xyz coordinate axis system (not shown). As to other particular embodiments, each of the first annular member outer or inner faces (4)(5) can independently be arcuate or curved (whether concavely arcuate, convexly arcuate, or combinations thereof), whereby one or more arcuate or curved lines connect the face's topmost and bottommost points which are coplanar within a z-plane of the xyz coordinate axis system (not shown). Additional variations are also contemplated and within the scope of the present invention.

Again referring primarily to FIGS. 1C, 1D, 2C, 2D, 3C, 3D, 4C, and 4D, as to particular embodiments, the thickness between the first annular member outer and inner faces (4)(5) can be generally uniform. As to other particular embodiments, the thickness between the first annular member outer and inner faces (4)(5) can be variable along the height or circumference (not shown).

Now referring primarily to FIGS. 1E, 1F, 1G, 1H, 2E, 2F, 2G, 2H, 3E, 3F, 3G, 3H, 4E, 4F, 4G, and 4H, as to particular embodiments, each of the first annular member upper or lower faces (6)(7) can independently be planar. As to other particular embodiments, each of the first annular member upper or lower faces (6)(7) can independently be arcuate or curved (whether concavely arcuate, convexly arcuate, or combinations thereof).

As to particular embodiments, the first annular member (3) can be flexible or capable of being relatively easily bent, which can be in contrast to a counterpart made from metal, such as a precious metal. This flexibility may be advantageous for precluding ring avulsions often associated with metal rings, as a flexible first annular member (3) may likely bend or break under stress before the ring finger is compromised. Additionally, in relation to a rigid counterpart, for example a metal ring, a flexible first annular member (3) may be (i) more comfortable, (ii) less likely to get stuck on a finger or constrict a swollen finger, and/or (iii) more easily removed from a finger.

As to particular embodiments, the first annular member (3) can be nonconductive or not able to conduct electricity or heat, which differs from a counterpart made from metal. Of course, nonconductivity may be beneficial for avoiding an electrical shock upon contact with electricity or a burn upon contact with heat, which may both occur upon contact with a conductive counterpart, such as a metal ring. For at least this reason, a nonconductive first annular member (3) may be significantly safer than its conductive counterpart, especially for wearers who work with electricity (such as electricians) or heat.

As to particular embodiments, the first annular member (3) can be nonmagnetic or lacking magnetic qualities, which may be favorable over a magnetic counterpart, such as a metal ring, when working proximate a magnetic field.

As to particular embodiments, the first annular member (3) can be one or more of hypoallergenic, chemically inert, and noncarcinogenic.

As to particular embodiments, the first annular member (3) can be less expensive than a metal counterpart and in particular, can be less expensive than a precious metal counterpart.

As to particular embodiments, the first annular member (3) can be formed from rubber or a rubber-like material.

As to particular embodiments, the first annular member (3) can be formed from one or more elastomers, whereby an elastomer can be a material (typically, but not necessarily, synthetic) having elastic properties akin to those of rubber. For example, the first annular member (3) can be formed from silicone.

As to particular embodiments, silicone may be a preferred material for forming the first annular member (3) because silicone can advantageously be one or more of flexible, nonconductive, nonmagnetic, hypoallergenic, chemically inert, noncarcinogenic, or relatively inexpensive. Of course, it is herein contemplated that some embodiments of the instant first annular member (3) may be formed from metal, but in certain instances, silicone may be preferable and even strongly preferred.

First Protrusion

Now referring primarily to FIGS. 1A through 4K, the first band (2) can further include at least two first protrusions (8) axially extending from one of the first annular member upper or lower faces (6)(7) in circumferentially spaced-apart relation, whereby the first protrusion (8) can have opposing first protrusion outer and inner faces (9)(10).

In this disclosure, the term "axially" means along an axis which can be generally parallel or parallel to a pass-through axis (13) of an annular member (3)(20). The term "axially extending from" can mean extending from a face in an axial direction (for example, the first protrusion axially extends from the first annular member upper (6) face in FIGS. 4A through 4K), or can mean directly extending from a face in an axial direction (for example, the first protrusion directly axially extends from the first annular member upper face (6) in FIGS. 1A through 3K), depending upon the embodiment.

The first protrusion (8) can have a numerous and wide variety of configurations, depending upon the particular embodiment. As but one illustrative example, the first protrusion (8) can be configured as a geometric shape, such as: a cube or cube-like shape having a generally square cross section, a cuboid or cuboid-like shape having a generally rectangular cross section, a cylinder or cylinder-like shape having a generally circular cross section, a triangular prism or triangular prism-like shape having a generally triangular cross section, a hexagonal prism or hexagonal-like shape having a generally hexagonal cross section, or the like, or combinations thereof. As but a second illustrative example, the first protrusion (8) can be configured to have a heart or heart-like shape. As but a third illustrative example, the first protrusion (8) can be configured to have an abstract shape, such as a flower, leaf, music note, sun, moon, butterfly, etc., depending on the desired design of the first protrusion (8) and overall stackable jewelry system (1).

The plurality of first protrusions (8) can be the same or different, depending upon the embodiment.

The spacing between the plurality of first protrusions (8) can be the same or different, depending upon the embodiment.

Now referring primarily to FIGS. 1A through 3K, as to particular embodiments, each of the first protrusion outer or inner faces (9)(10) can independently be a generally cylindrical surface, whereby a generally vertical line (parallel to the y-axis of an xyz coordinate axis system) connects the face's topmost and bottommost points which are coplanar within a z-plane of the xyz coordinate axis system. As to other particular embodiments, each of the first protrusion outer or inner faces (9)(10) can independently be a generally conical surface, whereby one or more angled lines connect the face's topmost and bottommost points which are coplanar within a z-plane of the xyz coordinate axis system (not shown). As to other particular embodiments, each of the first protrusion outer or inner faces (9)(10) can independently be arcuate or curved (whether concavely arcuate, convexly arcuate, or combinations thereof), whereby one or more arcuate or curved lines connect the face's topmost and bottommost points which are coplanar within a z-plane of the xyz coordinate axis system (not shown). Now referring primarily to FIGS. 4A through 4K, as to other particular embodiments, each of the first protrusion outer or inner faces (9)(10) can independently be a generally planar surface. Additional variations are also contemplated and within the scope of the present invention.

Now referring primarily to FIGS. 1A through 3K, as to particular embodiments, the thickness between the first protrusion outer and inner faces (9)(10) can be generally uniform. Now referring primarily to FIGS. 4A through 4K, as to other particular embodiments, the thickness between the first protrusion outer and inner faces (9)(10) can be variable along the height, circumference, or width.

As stated above, the first protrusions (8) can dispose in circumferentially spaced-apart relation, which can provide a first opening (11) therebetween.

Now referring primarily to FIGS. 1A through 3K, as to particular embodiments having a plurality of first protrusions (8) axially extending from a first annular member upper face (6), the first opening (11) between the first protrusions (8) can be bound (i) on its bottom by the first annular member upper face (6), (ii) on its left by the right side of one first protrusion (8), and (iii) on its right by the left side of another first protrusion (8). Notably, the top of the first opening (11) remains unbound and consequently, open.

Now referring primarily to FIGS. 3A through 3K, as to particular embodiments having a plurality of first protrusions (8) axially extending from a first annular member lower face (7), the first opening (11) between the first protrusions (8) can be bound (i) on its top by the first annular member lower face (7), (ii) on its left by the right side of one first protrusion (8), and (iii) on its right by the left side of another first protrusion (8). Notably, the bottom of the first opening (11) remains unbound and consequently, open.

Further, the first opening (11) can communicate with the first band interior space (12) defined or bounded by the first band (2). Following, a pass-through exists from the band interior space (12) to the first protrusion outer face (9) and the external environment therearound.

Now referring primarily to FIGS. 1A through 4K, at least one of (i) the first protrusion outer face (9) can be radially offset from the first annular member outer face (4), or (ii) the first protrusion inner face (10) can be radially offset from the first annular member inner face (5).

Now referring primarily to FIGS. 1A through 1K, and FIGS. 4A through 4K, as to particular embodiments, the first protrusion inner face (10) of at least one first protrusion (8) can be radially offset from the first annular member inner face (5). More specifically, as to particular embodiments, the first protrusion inner face (10) of at least one first protrusion (8) can be radially outwardly offset from the first annular member inner face (5), whereby this configuration provides an inward seat (14) on the first annular member upper or lower face (6)(7) which inwardly extends from the first protrusion inner face (10).

Now referring primarily to FIGS. 2A through 2K, as to other particular embodiments, the first protrusion outer face (11) of at least one first protrusion (8) can be radially offset from the first annular member outer face (4). More specifically, as to particular embodiments, the first protrusion outer face (11) of at least one first protrusion (8) can be radially inwardly offset from the first annular member outer face (4), whereby this configuration provides an outward seat (15) on the first annular member upper or lower face (6)(7) which outwardly extends from the first protrusion outer face (11).

Now referring primarily to FIGS. 1A through 1K, and FIGS. 4A through 4K, as to particular embodiments, all of the plurality of first protrusions (8) can be radially outwardly offset from the first annular member inner face (5); thus, the first annular member upper or lower face (6)(7) can include all inward seats (14).

Now referring primarily to FIGS. 2A through 2K, as to other particular embodiments, all of the plurality of first protrusions (8) can be radially inwardly offset from the first annular member outer face (4); thus, the first annular member upper or lower face (6)(7) can include all outward seats (15).

As to other particular embodiments, one or more of the plurality of first protrusions (8) can be radially outwardly offset from the first annular member inner face (5), and one or more of the plurality of first protrusions (8) can be radially inwardly offset from the first annular member outer face (4); thus, the first annular member upper or lower face (6)(7) can include both inward and outward seats (14)(15).

Now referring primarily to FIGS. 1A through 3K, as to particular embodiments, one of the first protrusion outer or inner faces (9)(10) can be radially offset to dispose at an intermediate location between the first annular member outer and inner faces (4)(5).

In this disclosure, the term "intermediate" means between two extremes. As to particular embodiments, intermediate can mean middle or equally distant from the extremes. As to other particular embodiments, intermediate need not mean middle.

Now referring primarily to FIGS. 1A through 1K, as to particular embodiments, the first protrusion outer face (9) can circumferentially align with the first annular member outer face (4). As to particular embodiments, the first protrusion inner face (10) can be disposed at the intermediate location.

Now referring primarily to FIGS. 2A through 2K, as to other particular embodiments, the first protrusion inner face (10) can circumferentially align with the first annular member inner face (5). As to particular embodiments, the first protrusion outer face (9) can be disposed at the intermediate location.

Now referring primarily to FIGS. 4A through 4K, as to particular embodiments, both (i) the first protrusion outer face (9) can be radially offset from the first annular member outer face (4), and (ii) the first protrusion inner face (10) can be radially offset from the first annular member inner face (5).

Again referring primarily to FIGS. 4A through 4K, as to particular embodiments, the first protrusion inner face (10) can be coupled to, directly coupled to, connected to, directly connected to, or integrated with the first annular member outer face (4), whereby the first protrusion (8) can radially outwardly extend from the first annular member outer face (4).

As to particular embodiments, the distance of the outward radial extension of the plurality of first protrusions (8) can be the same or different, depending upon the embodiment.

Now referring primarily to FIGS. 3A through 3K, as to particular embodiments, the first annular member (3) can include one or more first protrusions (8) extending axially upward from the first annular member upper face (6) (hence upward protrusions (17)), and one or more first protrusions (8) extending axially downward from the first annular member lower face (7) (hence downward protrusions (18)), whereby the upward and downward protrusions (17)(18) can be vertically aligned, vertically offset, or completely vertically offset, depending upon the embodiment.

As to particular embodiments, the first protrusion (8) can be formed from the same material as the first annular member (3).

As to particular embodiments, the first protrusion (8) and the first annular member (3) can be integrated, meaning that the components (i) can be united to provide a one-piece construct, a monolithic construct, or a unified whole, or (ii) can be formed as a one-piece construct, a monolithic construct, or a unified whole. Said another way, the first protrusion (8) and the annular member (3) can be integrally formed, meaning connected together so as to make up a single complete piece or unit, or so as to work together as a single complete piece or unit, and so as to be incapable of being easily dismantled without destroying the integrity of the piece or unit.

Second Band

Now referring primarily to FIGS. 5A through 10, as to particular embodiments, the stackable jewelry system (1) can further include a second band (19), whereby the second band (19) can include a second annular member (20).

As to particular embodiments, the second annular member (20) can be akin to the first annular member (3), whereby the second annular member (20) can include opposing second annular member outer and inner faces (21)(22) coupled together by second annular member upper and lower faces (23)(24), all of which may be similar to those of the first annular member (3) described above.

The second band (19) can further include at least one second protrusion (25) axially extending from one of the second annular member upper or lower faces (23)(24), whereby the second protrusion (25) can have opposing second protrusion outer and inner faces (26)(27). The second protrusion (25) can be comparable to the first protrusion (8) described above. Accordingly, at least one of (i) the second protrusion inner face (27) can be radially offset from the second annular member inner face (22), or (ii) the second protrusion outer face (26) can be radially offset from the second annular member outer face (21).

Now referring primarily to FIGS. 5A through 6C, as to particular embodiments, the second band (19) can be similar or identical to the first band (2).

As to particular embodiments, like the first band (2), the second band (19) can include (i) at least two second protrusions (25) axially extending from one of the second annular member upper or lower faces (23)(24) in circumferentially spaced-apart relation, and (ii) a second opening (28) between the second protrusions (25), whereby the second opening (28) communicates with a second band interior space (29).

Stacking

Again referring primarily to FIGS. 5A through 10, the first and second bands (2)(19) can be stackable to form a stacked configuration (30) in which the first and second bands (2)(19) dispose in coaxial relation. To provide a frame of reference in conjunction with the figures for aiding in the reader's understanding of the present invention, the first band (2) is shown on the bottom or below the second band (19), and the second band (19) is shown on the top or above the first band (2). Of course, this configuration should not be construed as creating limitations, as the reverse configuration can also be possible, whereby the first band (2) can be above the second band (19).

Again referring primarily to FIGS. 5A through 10, as to particular embodiments, when in the stacked configuration (30), the second protrusion (25) can be capable of radial alignment with the first opening (11).

Now referring primarily to FIGS. 5A through 8H, as to particular embodiments, when in the stacked configuration (30), the first and second annular members (3)(20) can dispose in axially spaced-apart relation.

Now referring primarily to FIGS. 5A through 6C, and FIGS. 8A through 8D, as to particular embodiments, when in the stacked configuration (30), the second protrusion (25) can axially extend into the first opening (11), whereby the second protrusion (25) can either partially or entirely fill the first opening (11), depending upon the embodiment.

Again referring primarily to FIGS. 5A through 6C, and FIGS. 8A through 8D, as to particular embodiments, when in the stacked configuration (30), the first and second protrusions (8)(25) can interdigitate.

Again referring primarily to FIGS. 5A through 6C, and FIGS. 8A through 8D, when in the stacked configuration (30), the first and second protrusion outer faces (9)(26) can be generally parallel or circumferentially align.

Again referring primarily to FIGS. 5A through 6C, and FIGS. 8A through 8D, as to particular embodiments, when in the stacked configuration (30), the first and second protrusion inner faces (10)(27) can be generally parallel or circumferentially align.

Now referring primarily to FIGS. 5A through 5C, and FIGS. 8A and 8B, as to particular embodiments, when in the stacked configuration (30), the first and second protrusion outer faces (9)(26) and the first and second annular member outer faces (4)(21) can be generally parallel or circumferentially align.

Figure 6C:
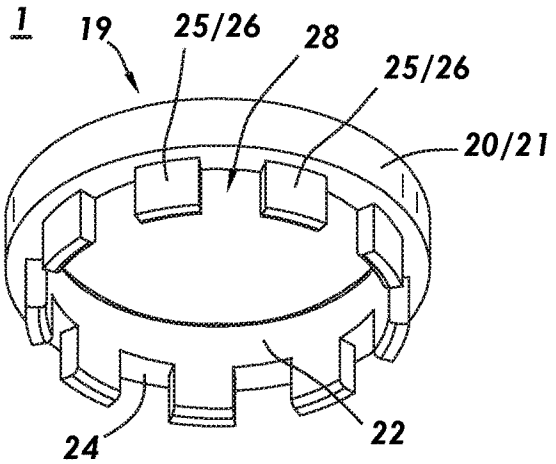
FIG. 6C shows a bottom perspective exploded view of the stacked configuration illustrated in FIG. 6A.
Figure 6C:
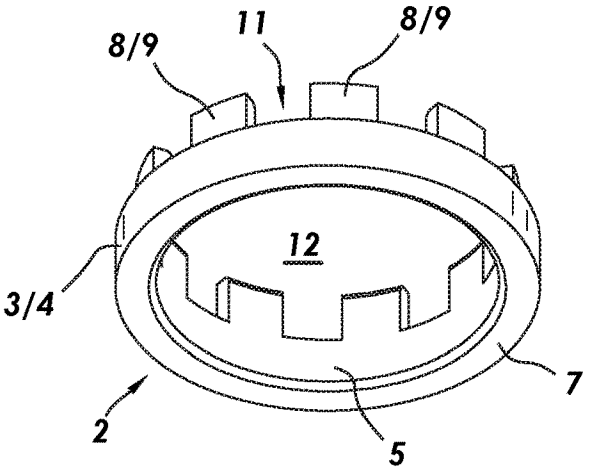
Figure 6B:
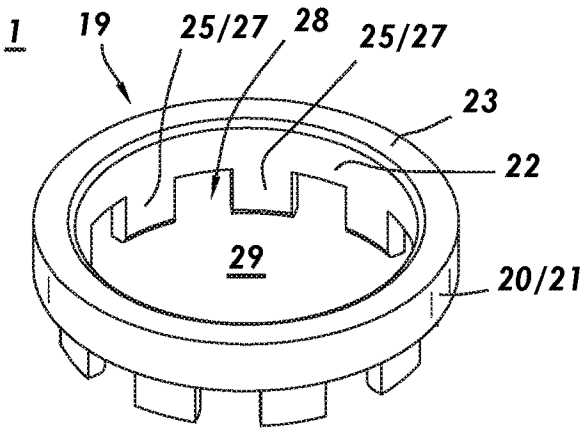
FIG. 6B shows a top perspective exploded view of the stacked configuration illustrated in FIG. 6A.
Figure 6B:
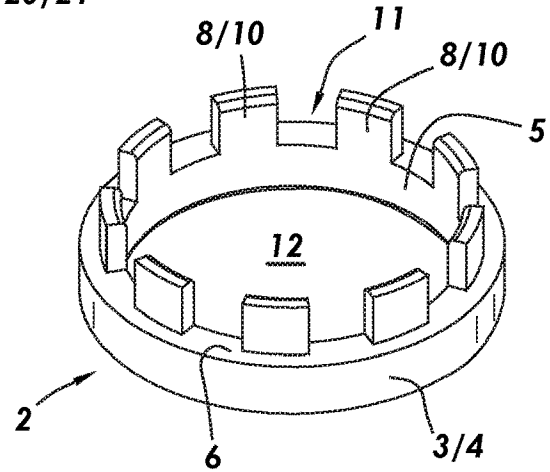
Figure 6A:
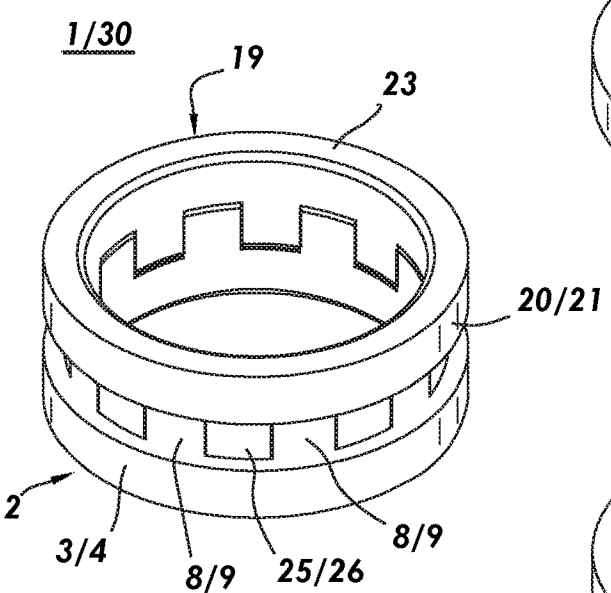
FIG. 6A shows a top perspective view of a stacked configuration of particular embodiments of first and second bands of the stackable jewelry system.

Now referring primarily to FIGS. 6A through 6C, as to particular embodiments, when in the stacked configuration (30), the first and second protrusion inner faces (10)(27) and the first and second annular member inner faces (5)(22) can be generally parallel or circumferentially align.

Now referring primarily to FIGS. 5A through 6C, and FIGS. 8A through 8D, as to particular embodiments, when in the stacked configuration (30), the first and second bands (2)(19) can interlock and thus, be unable to rotate in relation to one another.

Now referring primarily to FIGS. 7A through 7C, and FIGS. 8E through 8H, as to particular embodiments, when in the stacked configuration (30), the first and second protrusion outer faces (9)(26) can be radially offset.

Again referring primarily to FIGS. 7A through 7C, and FIGS. 8E through 8H, as to particular embodiments, when in the stacked configuration (30), the first and second protrusion inner faces (10)(27) can be radially offset.

Again referring primarily to FIGS. 7A through 7C, and FIGS. 8E through 8H, as to particular embodiments, when in the stacked configuration (30), the first protrusion outer face (9) can dispose in circumferentially adjacent relation to the second protrusion inner face (27), or the first protrusion inner face (10) can dispose in circumferentially adjacent relation to the second protrusion outer face (26).

Figure 7C:
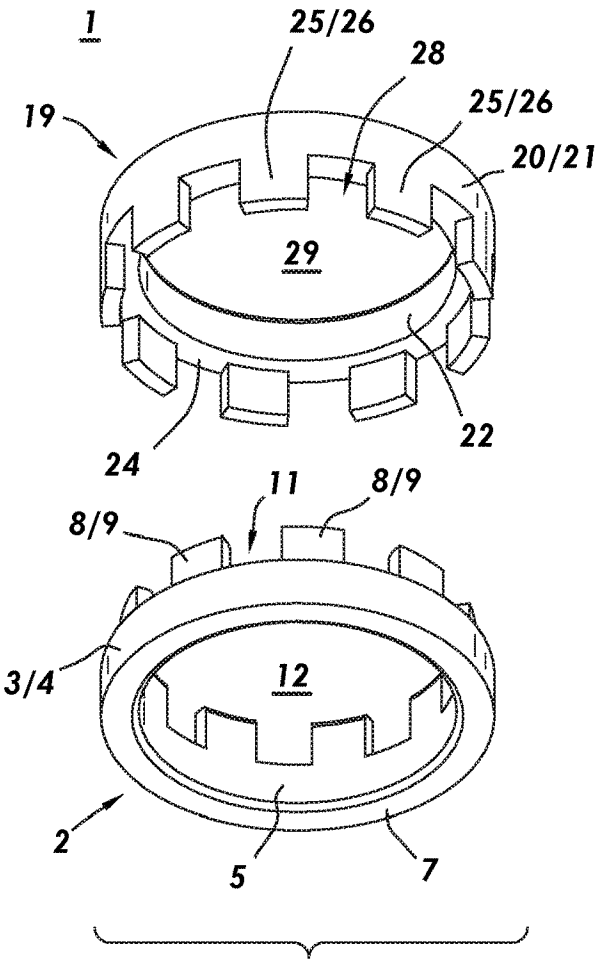
FIG. 7C shows a bottom perspective exploded view of the stacked configuration illustrated in FIG. 7A.
Figure 7B:
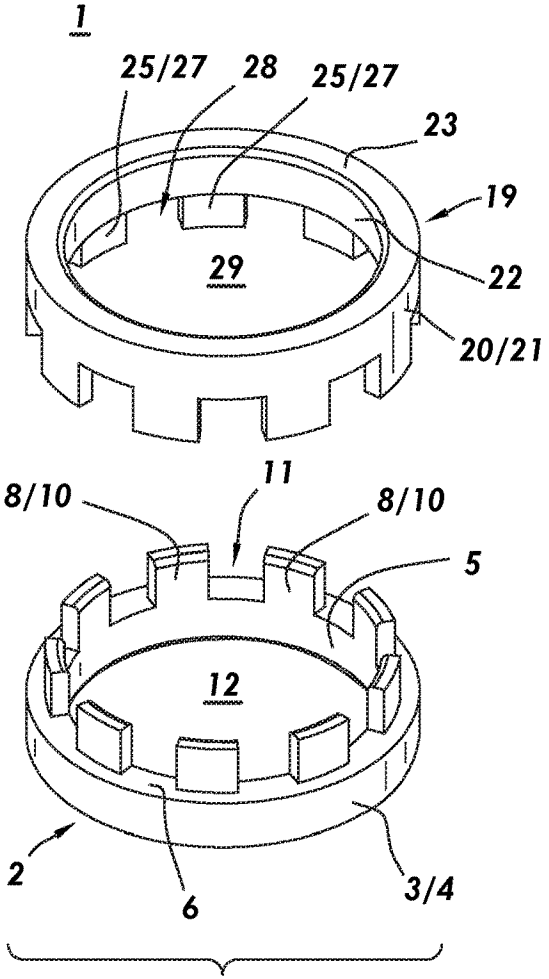
FIG. 7B shows a top perspective exploded view of the stacked configuration illustrated in FIG. 7A.
Figure 7A:
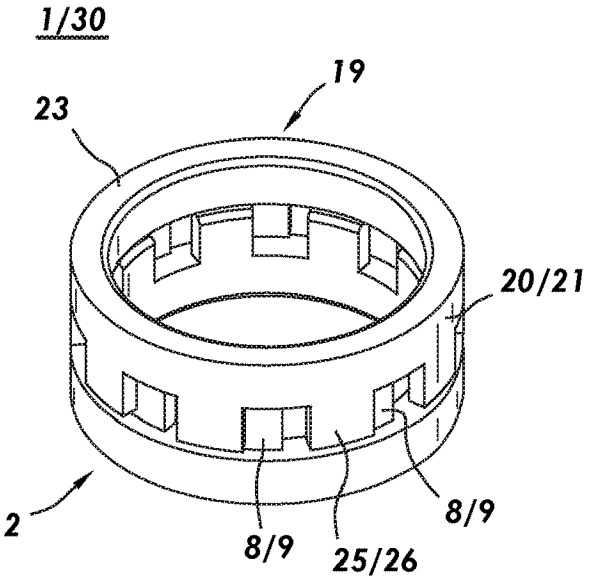
FIG. 7A shows a top perspective view of a stacked configuration of particular embodiments of first and second bands of the stackable jewelry system.
Figure 8A:
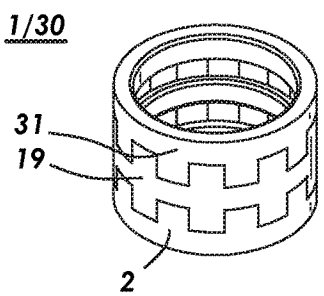
FIG. 8A shows a top perspective view of a stacked configuration of particular embodiments of a plurality of bands of the stackable jewelry system.
Figure 8B:
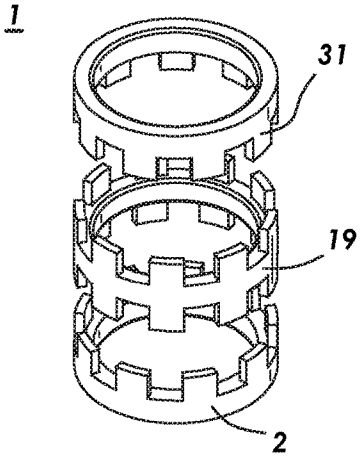
FIG. 8B shows a top perspective exploded view of the stacked configuration illustrated in FIG. 8A.
Figure 8C:
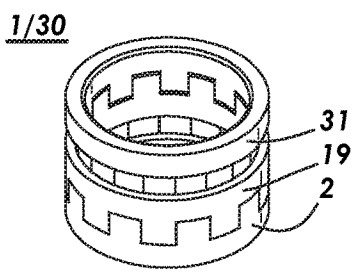
FIG. 8C shows a top perspective view of a stacked configuration of particular embodiments of a plurality of bands of the stackable jewelry system.
Figure 8D:
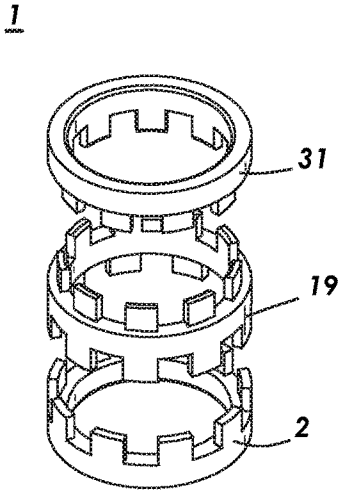
FIG. 8D shows a top perspective exploded view of the stacked configuration illustrated in FIG. 8C.
Figure 8E:
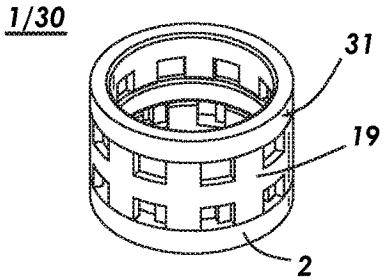
FIG. 8E shows a top perspective view of a stacked configuration of particular embodiments of a plurality of bands of the stackable jewelry system.
Figure 8F:
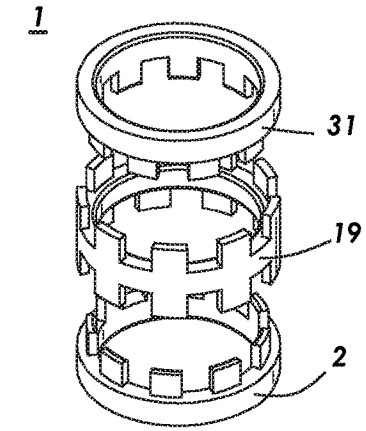
FIG. 8F shows a top perspective exploded view of the stacked configuration illustrated in FIG. 8E.
Figure 8G:
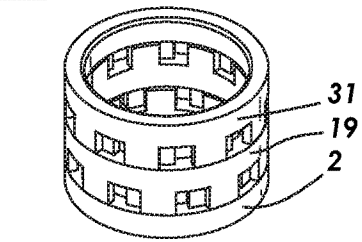
FIG. 8G shows a top perspective view of a stacked configuration of particular embodiments of a plurality of bands of the stackable jewelry system.
Figure 8H:
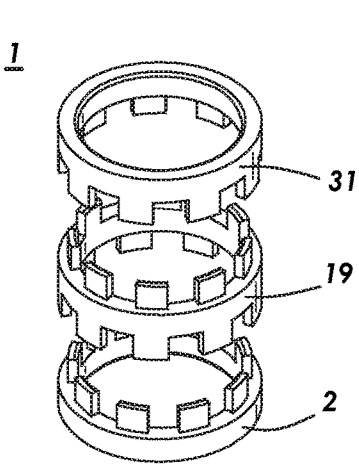
FIG. 8H shows a top perspective exploded view of the stacked configuration illustrated in FIG. 8G.
Figure 9A:
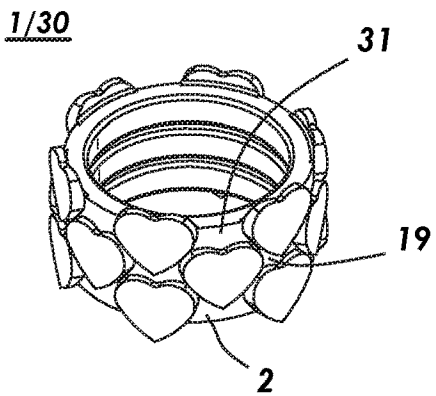
FIG. 9A shows a top perspective view of a stacked configuration of particular embodiments of a plurality of bands of the stackable jewelry system.
Figure 9B:
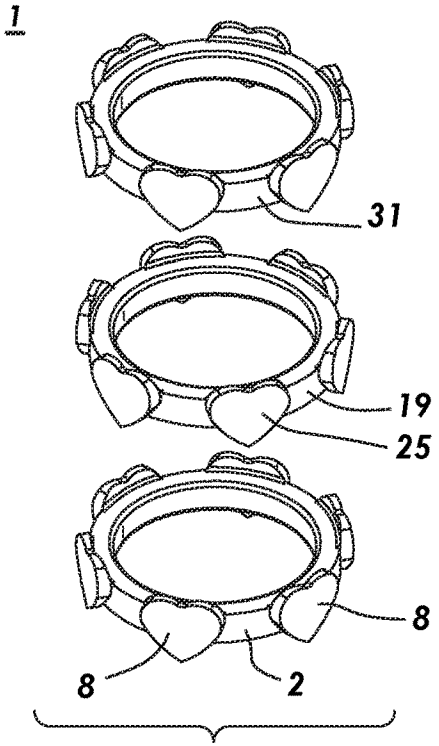
FIG. 9B shows a top perspective exploded view of the stacked configuration illustrated in FIG. 9A.
Figure 9C:
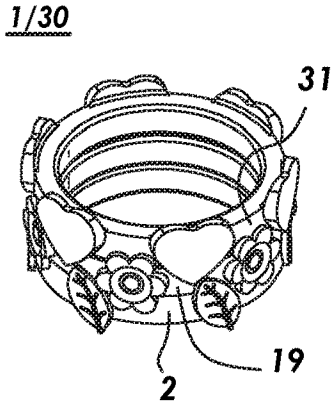
FIG. 9C shows a top perspective view of a stacked configuration of particular embodiments of a plurality of bands of the stackable jewelry system.
Figure 9D:
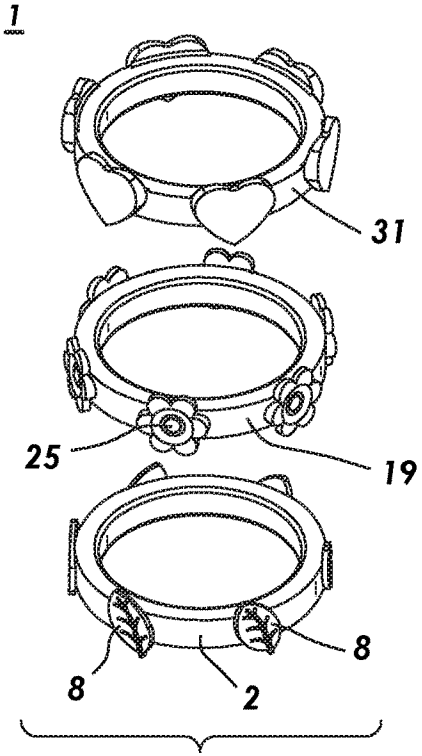
FIG. 9D shows a top perspective exploded view of the stacked configuration illustrated in FIG. 9C.
Figure 10A:
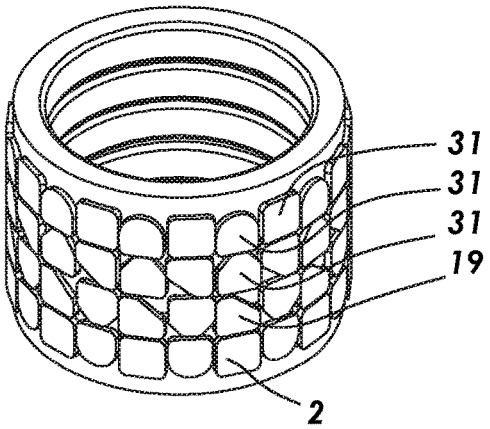
FIG. 10A shows a top perspective view of a stacked configuration of particular embodiments of a plurality of bands of the stackable jewelry system.
Figure 10B:
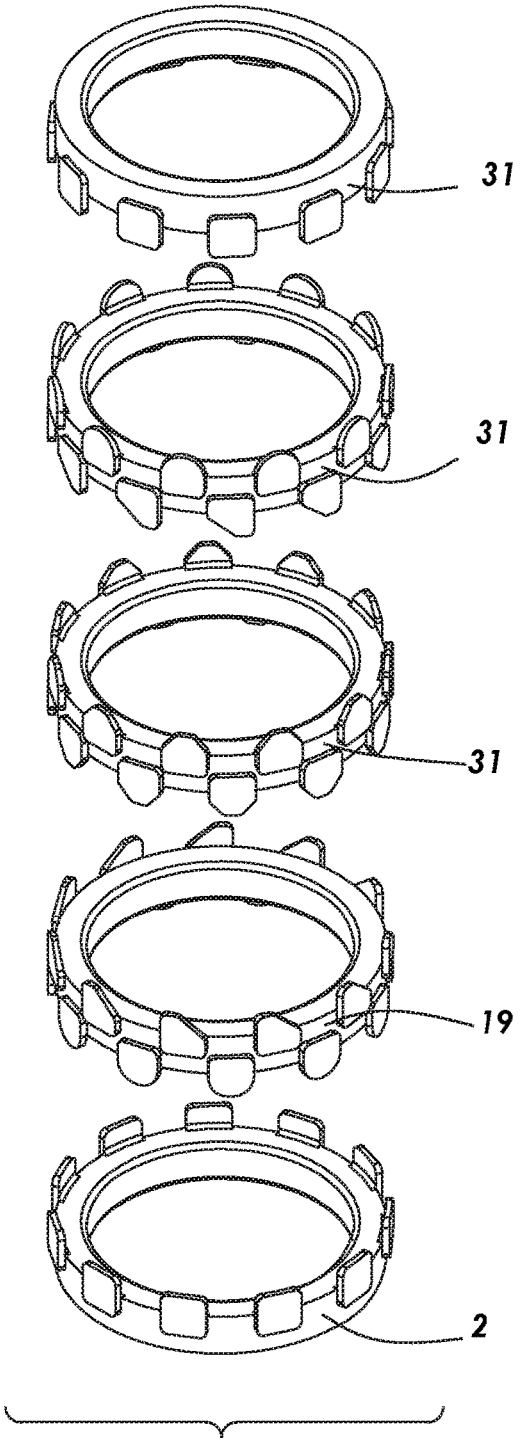
FIG. 10B shows a top perspective exploded view of the stacked configuration illustrated in FIG. 10A.

Again referring primarily to FIG. 7A, as to particular embodiments, when in the stacked configuration (30), the first band (2) can be rotatable about the second band (19), whereby the rotation axis can be parallel to or coincident with the pass-through axis (13).

Regarding embodiments having first and second bands (2)(19) in rotatable relation to one another, a protrusion (8)(25) can rotate between (i) complete radial alignment with the other band's opening (11)(28)) and (ii) complete radial alignment with the other band's protrusion (8)(25), whereby the rotation can include all radial alignment configurations therebetween. Concerning the latter, when the first protrusion (8) disposes in complete radial alignment with the second protrusion (25), the first protrusion (8) can be seated with the seat provided by the second protrusion (25) and vice versa, the second protrusion (25) can be seated within the seat provided by the first protrusion (8).

Again regarding embodiments having first and second bands (2)(19) in rotatable relation to one another, as to particular embodiments, the outer protrusion (8)(25) can be formed from a transparent or a translucent material. Following, the outer protrusion (8)(25) can appear as a first color when in complete radial alignment with the other band's opening (11)(28), and the outer protrusion (8)(25) can appear as a second color when in complete radial alignment with the other band's protrusion (8)(25). As but one illustrative example, the outer protrusion (8)(25) can be formed from a translucent red material and the other band's protrusion (8)(25) can be formed from a blue material; when the outer protrusion (8)(25) completely radially aligns with the other band's opening (11)(28), the outer protrusion (8)(25) can appear red, and when the outer protrusion (8)(25) completely radially aligns with the other band's protrusion (8)(25), the outer protrusion (8)(25) can appear purple.

Now referring primarily to FIGS. 9A through 10B, as to particular embodiments, when in the stacked configuration (30), the first and second annular members (3)(20) can dispose in axially adjacent relation, which can be in contrast to axially spaced-apart relation. Specifically, when in the stacked configuration (30), the first annular member upper face (6) can dispose in axially adjacent relation to the second annular member lower face (24). As to particular embodiments, when in axially adjacent relation, the first and second annular members (3)(20) can be in contact with one another.

Again referring primarily to FIGS. 9A through 10B, as to particular embodiments, when in the stacked configuration (30), a portion of the first protrusion (8) can overlay the second annular member outer face (21) and/or a portion of the second protrusion (25) can overlay the first annular member outer face (4).

Now referring primarily to FIGS. 8A through 10B, of course, the stackable jewelry system (1) can include additional bands (31) which can be combined with the first and second bands (2)(19), whereby all can all dispose in coaxial relation. Correspondingly, a numerous and wide variety of stacked configurations can be achieved by stacking various bands together, as the bands can be designed to "mix and match" with one another.

Production

Regarding production, a method of making the stackable jewelry system (1) can include providing the first and second bands (2)(19) having one or more of the components detailed above and in the claims.

As to particular embodiments, each of the first and second bands (2)(19) can be formed as a one-piece construct, a monolithic construct, or a unified whole.

As to particular embodiments, the first and second bands (2)(19) can be formed by molding or injection molding.

As to particular embodiments, the first and second bands (2)(19) can be molded or injection molded from silicone.

As to particular embodiments, the first and second bands (2)(19) can be formed from additive printing, such as three-dimensional (3D) printing.

Use

A method of using the stackable jewelry system (1) can include stacking the first and second bands (2)(19) detailed above.

As to particular embodiments, the method of use can further include disposing the first and second bands (2)(19) about a finger of a wearer.

As can be easily understood from the foregoing, the basic concepts of the present invention may be embodied in a variety of ways. The invention involves numerous and varied embodiments of a stackable jewelry system and methods for making and using such a stackable jewelry system.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "protrusion" should be understood to encompass disclosure of the act of "protruding"—whether explicitly discussed or not—and, conversely, were there effectively disclosure of the act of "protruding", such a disclosure should be understood to encompass disclosure of a "protrusion" and even a "means for protruding". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Additionally, for the purposes of the present invention, the term "integrated" when referring to two or more components means that the components (i) can be united to provide a one-piece construct, a monolithic construct, or a unified whole, or (ii) can be formed as a one-piece construct, a monolithic construct, or a unified whole. Said another way, the components can be integrally formed, meaning connected together so as to make up a single complete piece or unit, or so as to work together as a single complete piece or unit, and so as to be incapable of being easily dismantled without destroying the integrity of the piece or unit.

Thus, the applicant(s) should be understood to claim at least: i) each of the stackable jewelry systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A stackable jewelry system, comprising:

a first band comprising:

a first annular member having first annular member outer and inner faces coupled together by first annular member upper and lower faces;

at least two first protrusions axially extending from one of said first annular member upper or lower faces in circumferentially spaced-apart relation, said first protrusion having first protrusion outer and inner faces, said first protrusion inner face radially offset from said first annular member inner face; and a first opening between said first protrusions, said first opening communicating with a first band interior space;

a second band comprising:

a second annular member having second annular member outer and inner faces coupled together by second annular member upper and lower faces; and at least one second protrusion axially extending from one of said second annular member upper or lower faces, said second protrusion having second protrusion outer and inner faces, said second protrusion outer face radially offset from said second annular member outer face;

said first and second bands stackable to form a stacked configuration in which said first and second bands dispose in coaxial relation with said first and second protrusions facing each other;

wherein in said stacked configuration, said offsets of said first protrusion inner face and said second protrusion outer face are configured such that said first and second protrusions do not interdigitate.

2. The jewelry system of claim 1, said first and second annular members are flexible.

3. The jewelry system of claim 1, said first and second annular members are nonconductive.

4. The jewelry system of claim 1, said first and second annular members are formed from an elastomer.

5. The jewelry system of claim 1, said first and second annular members are formed from silicone.

6. The stackable jewelry system of claim 1, wherein in said stacked configuration, said second protrusion is capable of radial alignment with said first opening.

7. The stackable jewelry system of claim 6, wherein in said stacked configuration, said first and second annular members dispose in axially spaced-apart relation.

8. The stackable jewelry system of claim 1, wherein in said stacked configuration, said first and second protrusion inner faces dispose in radially offset relation.

9. The stackable jewelry system of claim 1, wherein said first and second bands are each sized to wear on a finger.

10. The stackable jewelry system of claim 1, said first protrusion outer face coplanar with said first annular member outer face.

11. The stackable jewelry system of claim 1, said second protrusion inner face coplanar with said second annular member inner face.

12. The jewelry system of claim 1, said first and second annular members are nonmagnetic.

* * * * *